US005460919A

United States Patent [19]

Obi et al.

[11] Patent Number: 5,460,919

[45] Date of Patent: Oct. 24, 1995

[54] PROCESS OF FORMING SUPER HIGH-CONTRAST NEGATIVE IMAGES AND SILVER HALIDE PHOTOGRAPHIC MATERIAL AND DEVELOPER BEING USED THEREFOR

[75] Inventors: Naoki Obi, Tokyo; Yasuhiko Kojima, Saitama; Yasuo Shigemitsu, Saitama; Jun Takeuchi, Saitama; Kiyoshi Suematsu, Tokyo, all of Japan

[73] Assignee: Dainippon Ink and Chemicals, Inc., Tokyo, Japan

[21] Appl. No.: 278,823

[22] Filed: Jul. 22, 1994

Related U.S. Application Data

[62] Division of Ser. No. 897,098, Jun. 11, 1992, Pat. No. 5,372,911.

[30] Foreign Application Priority Data

| | | | |
|---|---|---|---|
| Jun. 13, 1991 | [JP] | Japan | 3-141891 |
| Jun. 24, 1991 | [JP] | Japan | 3-151675 |
| Sep. 2, 1991 | [JP] | Japan | 3-221629 |
| Nov. 26, 1991 | [JP] | Japan | 3-310755 |
| Feb. 10, 1992 | [JP] | Japan | 4-23738 |
| Feb. 18, 1992 | [JP] | Japan | 4-30658 |

[51] Int. Cl.[6] ..... G03C 1/06

[52] U.S. Cl. ..... 430/264; 430/442; 430/436; 430/480; 430/478; 430/487; 430/490; 430/268

[58] Field of Search ..... 430/264, 442, 430/436, 480, 478, 487, 490, 268

[56] References Cited

U.S. PATENT DOCUMENTS

| | | | |
|---|---|---|---|
| 3,628,960 | 12/1971 | Phillippaerts et al. | 430/571 |
| 4,130,429 | 12/1978 | Van Doorselaer | 430/139 |
| 4,346,167 | 8/1982 | Imatomi et al. | 430/569 |
| 4,713,321 | 12/1987 | Mifume et al. | 430/570 |
| 4,740,453 | 4/1988 | Nakamura et al. | 430/264 |
| 5,206,125 | 4/1993 | Ogawa | 430/507 |
| 5,217,842 | 6/1993 | Kojima et al. | 430/264 |
| 5,275,915 | 1/1994 | Kojima et al. | 430/264 |
| 5,362,621 | 11/1994 | Obi et al. | 430/596 |

FOREIGN PATENT DOCUMENTS 0476613 3/1992 European Pat. Off. .

*Primary Examiner*—Thomas R. Neville

*Attorney, Agent, or Firm*—Armstrong, Westerman, Hattori, McLeland & Naughton

[57] ABSTRACT

A process of forming a super high-contrast negative image is disclosed, which comprises the steps of imagewise exposing a negative-working silver halide photographic material comprising a support having thereon one or more hydrophilic colloidal layers, at least one of the one or more hydrophilic colloidal layers being a negative-working silver halide emulsion layer, and then developing the photographic material with a developer containing an aminophenol derivative developing agent and a reductone compound in the existence of an organic compound having a negative reduction potential. A negative-working silver halide photographic material and a photographic developer being used for the image-forming process are also disclosed.

11 Claims, No Drawings

PROCESS OF FORMING SUPER HIGH-CONTRAST NEGATIVE IMAGES AND SILVER HALIDE PHOTOGRAPHIC MATERIAL AND DEVELOPER BEING USED THEREFOR

This is a divisional of application Ser. No. 07/897,098 filed Jun. 11, 1992, U.S. Pat. No. 5,372,911.

FIELD OF THE INVENTION

The present invention relates to an image forming process suitable for forming very high-contrast negative images useful for printing photomechanical process in graphic arts.

More particularly, the present invention relates to a process of forming super high-contrast negative images by developing a silver halide photographic material with a photographic developer containing at least an aminophenol derivative developing agent and a reductone compound in the existence of an organic compound having a negative reduction potential and capable of forming super high-contrast negative images after imagewise exposing the silver halide photographic material.

Furthermore, the present invention relates to a silver halide photographic material and a photographic developer being used for the foregoing image-forming process.

BACKGROUND OF THE INVENTION

In a printing photomechanical process for the graphic arts, the formation of sharp dot images or line images is required and hence an image-forming system showing very high-contrast photographic characteristics (in particular, 10 or higher in gamma) is necessary. Hitherto, for the purpose, a lith-type silver halide photographic material having a silver halide emulsion layer composed of a silver chlorobromide emulsion having a silver chloride content of more than 50%, and preferably more than 70% with a lith developer (lithographic developer) having a very low free sulfite ion concentration (usually, not higher than 0.1 mol/liter) has been used.

However, since for a lith-type silver halide photographic emulsion, a silver chlorobromide emulsion having a high silver chloride content must be used, it is difficult to attain a high sensitivity.

As other processes for obtaining high-contrast negative images, there are processes of using specific hydrazine derivatives disclosed in U.S. Pat. Nos. 4,168,977 4,224,401, 4,241,164, 4,269,929, 4,311,781, 4,650,746, 4,927,734, etc.

According to these processes, by processing surface latent image type silver halide photographic materials each containing a specific hydrazine derivative (generally, an acylphenylhydrazine derivative) as a nucleating agent with a developer having pH of from 11.0 to 12.3, photographic characteristics having a super high contrast of over 10 in gamma are obtained. According to these processes, a silver bromide emulsion or a silver chlorobromide emulsion having a high silver bromide content can be used, thereby a high sensitivity can be attained as compared with the case of using a lith-type silver halide emulsion.

However, it has been found that the foregoing high-contrast image-forming system using acylhydrazine derivative has various disadvantages. That is, the use of the foregoing image-forming system can give high-contrast negative images but at the same time is accompanied by the formation of pepper (black spot), which causes a serious problem in the photomechanical process. The pepper means black sesame-like spots formed at none-image area, i.e., undeveloped portions among dots, which causes serious damage on the commercial value of the light-sensitive materials for photomechanical process. Accordingly, various efforts have been made for developing a pepper-restraining technique but the attempt of restraining the formation of pepper is frequently accompanied by lowering the sensitivity and gamma. Thus, the development of an image-forming system for attaining a high sensitivity and a high contrast without accompanied by the formation of pepper has been strongly desired.

A second disadvantage of the conventional high-contrast image-forming systems is that a large amount of hydroquinone which is expensive and becomes a material causing an environmental pollution must be used for keeping the activity of the developer constant.

A lith developer is easily air-oxidized owing to a low sulfite ion concentration in the developer to greatly consume hydroquinone which is the developing agent.

Also, the developer for the high-contrast image-forming system using a hydrazine derivative is allowed to contain a sulfite at a high concentration but the developer is liable to be air-oxidized owing to the high pH (from 11 to 12.3) to greatly consume hydroquinone. Therefore, for keeping the developing activity of these developers, it is necessary to keep the amount of hydroquinone in the developer above a definite level by using a large amount of hydroquinone which is expensive and becomes a material causing an environmental pollution as described above or by replenishing the amount of hydroquinone consumed by the air-oxidation. Thus, the development of a high-contrast image-forming system by a developer causing less consumption of hydroquinone or without using hydroquinone as the developing agent has been desired.

SUMMARY OF THE INVENTION

A first object of the present invention is, therefore, to provide a process of forming negative images having a very high contrast of over 10 in gamma and forming less pepper by processing a silver halide photographic material with a developer without using hydroquinone as the developing agent.

A second object of the present invention is to provide a silver halide photographic material which is effectively used in the foregoing image-forming process.

A third object of the present invention is to provide a photographic developer without using hydroquinone as the developing agent, having low pH and being stable, which is effectively used for the foregoing image-forming process.

As the results of various investigations, it has now been discovered that the foregoing objects can be achieved by the present invention as described hereinbelow.

That is, the foregoing first object of the present invention can be achieved by an image-forming process, which comprises the steps of imagewise exposing a silver halide photographic material comprising a support having thereon one or more hydrophilic colloidal layers, at least one of said one or more hydrophilic colloidal layers being a negative-working silver halide emulsion layer, and then developing the silver halide photographic material with an alkaline developer containing at least aminophenol derivative developing agent and reductone compound in the existence of an organic compound having a negative reduction potential, preferably a reduction potential of more negative than −0.60 volt, and more preferably a reduction potential of more negative than −0.80 volt or the organic compound and a polyalkylene oxide or a derivative thereof.

The foregoing second object of the present invention can be achieved by a negative-type silver halide photographic material comprising a support having thereon one or more hydrophilic colloidal layers, at least one of said one or more hydrophilic colloidal layers being a negative-working silver halide photographic emulsion layer, wherein at least one of said one or more hydrophilic colloidal layers contains an organic compound having a negative reduction potential, preferably a reduction potential of more negative than −0.60 volt, and more preferably a reduction potential of more negative than −0.80 volt.

Also, the foregoing third object of the present invention can be achieved by a developer for a negative-type silver halide photographic material comprising (1) an aminophenol derivative developing agent, (2) a reductone compound, and (3) an organic compound having a negative reduction potential, preferably a reduction potential having more negative than −0.60 volt, and more preferably a reduction potential having more negative than −0.80 volt.

DETAILED DESCRIPTION OF THE INVENTION

Then, the present invention is described in detail.

In the image-forming process of the present invention, the image-exposed silver halide photographic material is developed with the foregoing alkaline developer in the existence of an organic compound having a negative reduction potential or the organic compound and a polyalkylene oxide or a derivative thereof.

As the organic compound having a negative reduction potential being used in this invention, heterocyclic compounds having at least one atom of N, O, S, Se and P are preferred, and dyes, pyridinium salts or the derivatives thereof represented by the following formula (N-I), quinolinium salts or the derivatives thereof represented by the following formula (N-II), and isoquinolinium salts or the derivatives thereof represented by the following formula (N-III) (hereinafter, the foregoing pyridium salts, quinolinium salts, isoquinolinium salts, and the derivatives of them are simply referred to as "pyridinium salt derivatives") are particularly preferred. t,0080 wherein $R_1$ represents an alkyl group, an amino group, an alkyl-substituted amino group, an aromatic group (phenyl, pyridyl, etc.), or —A—Z [wherein A represents an alkylene group having from 1 to 20 carbon atoms or $—CH_2CH{=}CHCH_2—$ and z represents a hydrogen atom, a phenyl group which may be substituted, a hydroxy group, an alkoxy group, an acyl group, an alkoxycarbonyl group, a cyano group, an N-alkylamide group, an amide group or a group represented by the following formula (a)]; t,0090

$R_2$ in formula (N-I) and formula (a) represents an alkyl group, an alkyl group substituted by a hydroxy group, an alkoxy group, or an aromatic group (phenyl, pyridyl, etc.) or an amide group; n1 represents 0 or an integer of from 1 to 3; when plural groups of $R_2$ exist, they may be the same or different; and $X^-$ represents an anion such as an iodine ion, a bromine ion, a chlorine ion, a p-toluenesulfonic acid ion, a perchloric acid ion, a methylsulfuric acid etc., however, when formula (N-I) is a betaine structure, $X^-$ does not exist. t,0100 wherein $R_3$ represents a substituted or unsubstituted lower alkyl group; $R_4$ and $R_5$ each independently represents a halogen atom, an alkyl group, a substituted alkyl group, or an alkoxy group; n2 and n3 each independently represents 0, 1, or 2, and when n2 and n3 each is 2, $R_4$s and $R_5$s each may be the same or different; and $X^-$ represents an anion such as an iodine ion, a bromine ion, a chlorine ion, a p-toluenesulfonic acid ion, a perchloric acid ion, a methylsulfuric acid ion, etc., but when formula (N-II) is a betaine structure, $X^{31}$ does not exist. t,0101 wherein $R_6$ represents an alkyl group or a substituted alkyl group and said $R_6$ may form a 6-membered ring or a 5-membered ring with $R_8$; $R_7$ represents a hydrogen atom, an alkyl group, a substituted alkyl group, or an aryl group; $R_8$ and $R_9$ each independently represents a hydrogen atom, an alkyl group, an alkyl group substituted with a hydroxy group, an alkoxy group, an aromatic group, etc., an alkoxy group, or an amide group; said $R^8$ and $R^9$ may form together an aromatic ring; $R_{10}$ represents a halogen atom, an alkyl group which may be substituted, an alkoxy group, or an amino group which may be substituted with an alkyl group; n4 represents 0, 1, or 2, when n4 is 2, $R_{10}$s may be the same or different; and $X^{31}$ represents an anion such as an iodine ion, a bromine ion, a chlorine ion, a p-toluenesulfonic acid ion, a perchloric acid ion, a methylsulfuric acid ion, etc., but when formula (N-III) is a betaine structure, $X^{31}$ does not exist.

Now, the value of the reduction potential (Ered) in this invention means a potential at which the dyes or the pyridinium salt derivatives each is reduced by the injection of electron at the cathode in a voltammetry. The value of the reduction potential (Ered) can be correctly measured by a voltammetry. That is, the voltammogram of from $1\times10^{-3}$M to $1\times10^{-4}$M of the dye or the pyridinium salt derivative is measured in acetonitrile containing 0.1M of tetra-n-butylammonium perchlorate as a supporting electrolyte and the value of Ered is determined as a half wave potential obtained therefrom. Platinum is used as the working electrode, a saturated calomel electrode (SCE) is used as a reference electrode, and the measurement is carried out at 25° C. The details thereof are described in P. Delahay, *New Instrumental Methods in Electrochemistry*, published by Interscience Publishers, 1954.

As a silver halide photographic material particularly useful for the image-formation process of the present invention, there is a negative-working silver halide photographic material having on a support at least one negative-working silver halide emulsion layer, wherein said silver halide emulsion layer and/or at least one other hydrophilic colloidal layer contains at least one kind of the dyes or the pyridinium salt derivatives each having a negative reduction potential; at least one kind of the dyes or the pyridinium salt derivatives each having a negative reduction potential and at least one kind of polyalkylene oxides and the derivatives thereof; or at least one kind of the dyes or the pyridinium salt derivatives each having a negative reduction potential and at least one kind of an inorganic or organic compound having an acidic dissociation constant (pKa) of lower than 11 or the salts thereof.

Also, as a photographic developer particularly useful for the image-forming process of the present invention, there is a photographic developer containing at least (1) an aminophenol derivative developing agent and (2) a reductone compound or a photographic developer containing at least (1) an aminophenol derivative developing agent and (2) a reductone compound together with a quaternary ammonium salt compound represented by the following formula (C-I), or at least one kind of an amine represented by the following formula (C-II) or (C-III), or a cyclic imino compound represented by the following formula (C-IV); t,0130 wherein $R_{11}$, $R_{12}$, $R_{13}$, and $R_{14}$, which may be the same or different, each represents an unsubstituted alkyl group having from 1 to 20 carbon atoms; an alkyl group having from 1 to 20 carbon atoms substituted with a halogen atom, a hydroxy group, an alkoxy group, an acyloxy group, a carbamoyl group, a trialkylammonium group, an alkyl group, etc.; an alkenyl group; a cycloalkyl group which may be unsubstituted or substituted; an aralkyl group which may be unsubstituted or substituted; or an aryl group which may be unsubstituted or substituted and $X^{31}$ represents an anion. t,0140 wherein $R_{15}$, $R_{16}$, and $R_{17}$ each independently represents a hydrogen atom, an alkyl group having from 1 to 10 carbon atoms which may be unsubstituted or substituted, a cycloalkyl group having from 3 to 10 carbon atoms which may be unsubstituted or substituted, an aralkyl group having from 7 to 10 carbon atoms which may be unsubstituted or substituted, or an aryl group having from 6 to 10 carbon atoms which may be unsubstituted or substituted, a ring may be formed by optional two groups selected from $R_{15}$, $R_{16}$, and $R_{17}$, with the exception that $R_{15}$, $R_{16}$, and $R_{17}$ are simultaneously a hydrogen atom. t,0141 wherein $R_{18}$, $R_{19}$, $R_{20}$, and $R_{21}$ each independently represents a hydrogen atom, an alkyl group having from 1 to 8 carbon atoms which may be unsubstituted or substituted, or a cycloalkyl group having from 3 to 8 carbon atoms, a ring may be formed by optional two groups selected from $R_{18}$, $R_{19}$, $R_{20}$, and B represents an alkylene group having from 2 to 8 carbon atoms, $—(E—CH_2CH_2—)_f—$, or $—(E—CH_2CH_2CH_2—)_g—$ (wherein E represents an oxygen atom, a sulfur atom or —NH— and f and g each represents an integer of from 1 to 4). t,0150 wherein $Q_1$ represents a nonmetallic atomic group necessary for forming an aromatic nitrogen-containing heterocyclic ring and as the aromatic nitrogen-containing heterocyclic ring completed by $Q_1$, there are a pyridine ring, a quinoline ring, an isoquinoline ring, an acridine ring, a pyridazine ring, a pyrimidine ring, a pyrazine ring, a cinnoline ring, a quinazoline ring, a quinoxaline ring, a phthalazine ring, and a phenazine ring, each may be unsubstituted or substituted.

Also, the reductone compounds being preferably used for the alkaline developer for use in this invention are the compounds represented by the following formula (I) or the salts thereof. t,0160 wherein $R_{22}$ represents a hydrogen atom or a hydroxy group and l represents an integer of from 1 to 4.

As the dyes for use in the present invention, symmetric type and asymmetric type cyanin dyes and merocyanine dyes are useful.

Particularly useful dyes for use in this invention are compounds represented by the following formula (D-I), (D-II), (D-III), or (D-IV) each having a negative reduction potential, preferably a reduction potential of more negative than −0.60 volt, and more preferably a reduction potential of more negative than −0.80 volt; t,0170 wherein m1 represents 0 or 1; $Q_2$ and $Q_3$ each represents a nonmetallic atomic group necessary for forming a nitrogen-containing heterocyclic ring such as, e.g., a benzothiazole ring, a naphthothiazole ring, a benzoselenazole ring, a benzoxazole ring, a quinoline ring, and a thiazoline ring each may be. substituted with an alkyl group such as methyl, ethyl, etc., a halogen atom, an alkoxy group such as methoxy, etc.; $R_{23}$ and $R_{24}$ each represents an alkyl group such as methyl, ethyl, propyl, etc., a substituted alkyl group having a carboxy group, such as carboxy-methyl, β-carboxyethyl, etc., a substituted alkyl group having a sulfo group, such as β-sulfoethyl, γ-sulfopropyl, etc., an a allyl group or a substituent which is usually used as an N-substituent of cyanine dyes; $R_{25}$ represents a hydrogen atom or an alkyl group such as methyl, ethyl, etc.; and $X^{31}$ represents an anion which is usually used for forming a cyanine dye salt, such as an iodine ion, a bromine ion, a chlorine ion, a perchloric acid ion, a p-toluenesulfonic acid ion, a methylsulfuric acid ion, etc., but when the cyanine dye has a betaine structure, $X^{31}$ does not exist. t,0180 wherein Y represents an oxygen atom or a sulfur atom; m2 represents 0 or 1; $Q_4$ represents a nonmetallic atomic group necessary for forming a nitrogen-containing heterocyclic ring such as a thiazole ring, a thiazoline ring, a pyrroline ring, a quinoline ring, a tetrazole ring, etc., each may be substituted with an alkyl group such as methyl, ethyl, etc., a halogen atom, an alkoxy group such as methoxy, etc.; $R_{26}$ and $R_{27}$ each represents an alkyl group such as methyl, ethyl, etc., a substituted alkyl group having a carboxy group (including a carboxy group containing a quaternary ammonium salt such as a trimethylammonium salt, etc.), such as carboxymethyl, β-carboxyethyl, etc., a substituted alkyl group having a hydroxy group, such as hydroxymethyl, β-hydroxyethyl, etc., or an allyl group; and $R_{28}$ represents a hydrogen or an alkyl group such as methyl, ethyl, etc. t,0190 wherein $R_{29}$ represents a hydrogen atom or an alkyl group such as methyl, ethyl, propyl, etc.; $R_{30}$, $R_{31}$, $R_{32}$, and $R_{33}$each independently represents a hydrogen atom, a halogen atom, an alkyl group such as methyl, ethyl, etc., an amino group, or an amino group substituted with an alkyl group such as methyl, ethyl, etc.; $R_{34}$ represents an unsubstituted phenyl group or a phenyl group substituted with an amino group, a dialkylamino group, a carboxyl group, etc.; and $X^{31}$ represents an anion which is usually used for forming a dye salt, such as an iodine ion, a bromine ion, a chlorine ion, a perchloric acid ion, a p-toluenesulfonic acid ion, a methylsulfuric acid ion, etc. t,0200 wherein $Q_5$ represents a nonmetallic atomic group necessary for forming a nitrogen-containing heterocyclic ring such as a benzothiazole ring, a naphthothiazole ring, a benzoselenazole ring, a benzoxazole ring, a quinoline ring, a thiazoline ring, etc., each may be substituted with an alkyl group such as methyl, ethyl, etc., a halogen atom, an alkoxy group such as methoxy, etc.; $R_{35}$ and $R_{36}$ each independently represents a hydrogen atom or an alkyl group such as methyl, ethyl, propyl, etc.; $R_{37}$ and $R_{38}$ each independently represents a hydrogen atom, an alkyl group such as methyl, ethyl, etc., an alkyl group substituted with a halogen atom, such as β-chloroethyl, etc., an unsubstituted phenyl group, or a phenyl group substituted with an alkyl group such as methyl, ethyl, etc., a halogen atom, or an alkoxy group such as methoxy, etc.; and $X^{31}$ represents an anion which is usually used for forming a dye salt, such as an iodine ion, a bromine ion, a chlorine ion, a perchloric acid ion, a p-toluenesulfonic ion, a methylsulfuric acid ion, etc.

Then, specific examples of the dye for use in the present invention are illustrated below but the invention is not limited to these dyes. t,0220

The foregoing dyes can be easily synthesized by the methods described, e.g., in F. H. Hamer, *The cyanine Dyes and Related Compounds*, published by Interscience Publishers, N.Y., 1964, page 55 et seq. and similar methods to them.

The pyridinium salt derivatives useful for use in the present invention are the compounds shown by formula (N-I), (N-II), or (N-III) described above.

The compounds shown by the foregoing formulae are described again in more detail.

In formula (N-I), $R_1$ represents an alkyl group, an amino group, an alkyl-substituted amino group (N-methylamino, N,N-dimethylamino, etc.), an aromatic group such as phenyl, pyridyl, etc., or —A—Z (wherein A represents an alkylene group having from 1 to 20 carbon atoms or $CH_2CH{=}CHCH_2$ and Z represents a hydrogen atom, a phenyl group which may be unsubstituted or substituted, a hydroxy group, an alkoxy group such as methoxy, ethoxy, etc., an acyl group such as benzyl, acetyl, etc., an alkoxycarbonyl group such as methoxycarbonyl, ethoxycarbonyl, etc., a cyano group, an N-alkylamide group, an amide group, or a group shown by formula (a) described above.

Also, in formula (N-I) and formula (a), $R_2$ represents an alkyl group (methyl, ethyl, propyl, butyl, etc.), an alkyl group substituted with a hydroxy group, an alkoxy group, or an aromatic group such as phenyl, pyridyl, etc., [e.g., 2-hydroxyethyl, 3-hydroxypropyl, 2-methoxyethyl, 4-ethoxybutyl, benzyl, 2-phenylethyl, and 3-(4-pyridyl)propyl], or an amide group (such as —$CONH_2$, —$CONHCH_3$, etc.); n1 represents 0 or an integer of from 1 to 3; when plural $R_2$s exist, they may be the same or different; and $X^{31}$ represents an anion such as an iodine ion, a bromine ion, a chlorine ion, a p-toluenesulfonic acid ion, a perchloric acid ion, a methylsulfuric acid ion, etc., but when formula (N-I) is a betaine structure, $X^{31}$ does not exist.

In formula (N-II), $R_3$ represents an unsubstituted alkyl group or an alkyl group substituted preferably with a hydroxy group, an alkoxy group such as methoxy, ethoxy, etc., an aromatic group such as phenyl, etc., an acyl group such as acetyl, benzoyl, etc., an alkoxycarbonyl group such as methoxycarbonyl, ethoxycarbonyl, etc., an amide group, a cyano group, etc. Practical examples of $R_3$ are methyl, ethyl, n-propyl, isopropyl, n-butyl, isobutyl, pentyl, 2-hydroxyethyl, 3-hydroxypropyl, 2-methoxyethyl, 3-ethoxypropyl, 2-phenylethyl, 3-acetylpropyl, 2-benzoylethyl, 2-methoxycarbonylethyl, 2-cyanoethyl, and 2-carbamoylethyl. $R_4$ and $R_5$ each independently represents a halogen atom, an alkyl group (e.g., methyl, ethyl, n-propyl, isopropyl, n-butyl, isobutyl, and pentyl), a substituted alkyl group, or an alkoxy group (e.g., methoxy and ethoxy). As the substituent for the substituted alkyl group described above, a hydroxy group, an alkoxy group, and a substituted or unsubstituted aromatic group (e.g., phenyl and alkyl-substituted phenyl) are preferable. Also, practical examples of the substituted alkyl group are hydroxymethyl, 2-hydroxyethyl, 3-hydroxypropyl, 2-methoxyethyl, 2-ethoxyethyl, benzyl, 2-phenylethyl, and 2-tolylethyl. n2 and n3 each independently represents 0, 1, or 2. When plural $R_4$s and/or $R_5$s exist, they may be the same or different. $X^-$ represents an anion as an iodine ion, a bromine ion, a chlorine ion, a p-toluenesulfonic acid ion, a perchloric acid ion, a methylsulfuric acid, etc., but when formula (N-II) is a betaine structure, $X^{31}$ does not exist.

In formula (N-III), $R_6$ represents an alkyl group (such as methyl, ethyl, propyl, butyl, pentyl, etc.) or a substituted alkyl group; said $R_6$ may form a 6-membered ring or a 5-membered ring together with $R_8$; $R_7$ represents a hydrogen atom, an alkyl group (such as methyl, ethyl, propyl, butyl, pentyl, etc.), a substituted alkyl group, or an aryl group (such as phenyl, alkyl-substituted phenyl, etc.). As the substituent of the substituted alkyl group shown by $R_6$ and $R_7$, there are, for example, a hydroxy group, an alkoxy group (such as methoxy, ethoxy, etc.), and an aryl group (such as phenyl, alkyl-substituted phenyl, etc.). Specific examples of the substituted alkyl group are 2-hydroxyethyl, 3-hydroxypropyl, 2-methoxyethyl, 2-ethoxyethyl, 3-methoxypropyl, benzyl, and 2-phenylethyl. $R_8$ and $R_9$ each independently represents a hydrogen atom, an alkyl group (such a methyl, ethyl, propyl, etc.), an alkyl group substituted with a hydroxy group, an alkoxy group, an aromatic group, etc., (such as 2-hydroxyethyl, 3-hydroxypropyl, 2-methoxyethyl, 3-ethoxypropyl, benzyl, 2-phenylethyl, etc.), an alkoxy group (such as methoxy, ethoxy, etc.), or an amide group. Furthermore, $R_8$ and $R_9$ may form together an aromatic ring. $R_{10}$ represents a halogen atom (chlorine, bromine, etc.), an alkyl group which may be unsubstituted or substituted (such as methyl, ethyl, propyl, 2-hydroxyethyl, 3-hydroxypropyl, 2-methoxyethyl, benzyl, etc.), an alkoxy group (such as methoxy, ethoxy, etc.), or an amino group which may be substituted with an alkyl group. Also, n4 represents 0, 1, or 2. When plural $R_{10}$s exist, they may be the same or different. $X^{31}$ represents an anion such as an iodine ion, a bromine ion, a chlorine ion, a p-toluenesulfonic acid ion, a perchloric acid ion, a methylsulfuric acid ion, etc., but when formula (N-III) is a betaine structure, $X^{31}$ does not exist.

Then, specific examples of the pyridinium salt derivatives for use in the present invention are illustrated below but the invention is not limited to those compounds. t,0420

These pyridinium salt derivatives can be synthesized by reacting corresponding pyridine derivatives, quinoline derivatives, or isoquinoline derivatives and alkyl halides as described in Munio Kotake, *Dai Yuuki Kagaku (Principal Organic Chemistry)*, Vol. 16, (III), pages 7 and 125, published by Asakura Shoten, 1959. Practical synthetic methods of them are described in A. Grob and E. Renk, *Helv. Chim. Acta.*, 37, 1672(1954); R. E. Lyle, E. F. Perlowski, H. J. Troscianiec, and G. G. Lyle, *J. Org. Chem.*, 20, 1716(1955); M. R. Lamborg, R. M. Burton, and N. O. Kaplan, *J. Am. Chem. Soc.*, 79, 6173(1957); and W. Ciusa and A. Buccelli, *Gazetta Chimia Italiana*, 88, 393(1958).

The foregoing dye or pyridinium salt derivative for use in this invention can contain in at least one negative-working silver halide emulsion constituting the silver halide photographic material or other light-insensitive layer composed of a hydrophilic colloidal layer such as a protective layer, an interlayer, an antihalation layer, a filter layer, etc.

The addition amount of the dye and the pyridinium salt derivative to the silver halide photographic material is suitable in the range of from $1\times10^{-6}$ mol to $1\times10^{-2}$ mol per mol of silver halide, and in the case of adding the dye alone, the amount is preferably from $1\times10^{-3}$ mol to $1\times10^{-1}$ mol, and in the case of the pyridinium salt derivative alone, the amount is preferably from $1\times10^{-4}$ mol to $1\times10^{-2}$ mol, and when a polyalkylene oxide or the derivative thereof (hereinafter, they are referred to as simply polyalkylene oxide derivatives) exists, the amount of the dye or the pyridinium salt derivative is particularly preferably from $1\times10^{-5}$ mol to $1\times10^{-3}$ mol.

Also, the dyes and the pyridinium salt derivatives for use in the present invention can be used singly or as a combination of them.

For adding the dye or the pyridinium salt derivative for use in this invention to the negative-working silver halide emulsion layer or the other light-insensitive hydrophilic colloidal layer, the dye or the pyridinium salt derivative may be added to the negative-working silver halide emulsion or an aqueous solution of a light-insensitive hydrophilic colloid for use in this invention as a solution thereof in water or an organic solvent miscible with water, such as alcohols, ketones, esters, amides, etc.

The dye or the pyridinium salt derivative for use in this invention can be added thereto at any desired step during the production of the silver halide photographic material. For example, in the case of adding to the negative-working silver halide emulsion, the compound can be added thereto at an optional time from the initiation of the chemical ripening of the silver halide emulsion before coating the emulsion but it is preferred to add the compound at an optional time after chemical ripening of the silver halide emulsion and immediately before coating. Furthermore, the compound may be added to the silver halide photographic material after imagewise exposing the silver halide photographic material.

Also, the dye and/or the pyridinium salt derivative for use in this invention may be added to a developer and in this case, the content thereof is preferably from $1\times10^{-6}$ mol/liter to $1\times10^{-1}$ mol/liter.

The action and mechanism of the dyes and the pyridinium salt derivatives for use in this invention have not yet been clarified but since it is not always necessary that they exist at image exposure of the silver halide photographic material, the dyes do not take part in the ordinary spectral sensitization. It is assumed that the dyes and the pyridinium salt derivatives for use in this invention act as contrast-increasing agents for increasing the sensitivity and the contrast of the silver halide photographic material at development thereof. In the image-forming process using an alkaline developer containing an aminophenol derivative developing agent and a reductone compound, the remarkably high sensitivity and super high contrast imparting actions by the dyes and the pyridinium salt derivatives for use in this invention have never been known before the present invention and are entirely unexpected effects.

In the case of forming a very high-contrast negative image by the image-forming process of the present invention by carrying out the development in the existence of the polyalkylene oxide derivative, negative images having a far better super high contrast can be obtained.

As the polyalkylene oxide derivative for use in the present invention, there are a polyalkylene oxide such as polyethylene oxide, polypropylene oxide, etc., an addition polymer of a polyalkylene oxide such as polyethylene oxide, polypropylene oxide, etc., and at least one compound selected from water, aliphatic alcohols, phenols, glycols, fatty acids, and organic amines; a condensate of a polyalkylene oxide and one compound selected from the foregoing compounds, and a block copolymer of various alkylene oxides with each other (e.g., ethylene oxide and propylene oxide).

The number-average molecular weight of the polyalkylene oxide derivative for use in this invention is preferably from 500 to 20,000 and particularly preferably from 1,000 to 10,000.

Then, specific examples of the polyalkylene oxide derivative for use in this invention are shown below. t,0650

The polyalkylene oxide derivative for use in this invention may be incorporated in the silver halide photographic material or the developer but is preferably incorporated in the silver halide photographic material.

For incorporating the polyalkylene oxide derivative in the silver halide photographic material, the compound may be added to the negative-working silver halide emulsion layer or other light-insensitive hydrophilic colloidal layer such as a protective layer, an interlayer, an antihalation layer, a filter layer, etc. However, it is preferred that the polyalkylene oxide derivative is added to the negative-working silver halide emulsion for use in this invention.

For incorporating the polyalkylene oxide derivative for use in this invention in the silver halide photographic material, the compound may be added to the negative-working silver halide emulsion for use in this invention or an aqueous light-insensitive hydrophilic colloidal solution as a solution thereof in water or an organic solvent miscible with water, such as alcohols, ketones, esters, amides, etc.

The addition amount of the polyalkylene oxide derivative for use in this invention to the silver halide photographic material is suitable in the range of from 0.1 g to 10 g, and particularly preferably in the range of from 1 g to 5 g per mol of silver halide.

The compound can be added thereto at any desired step during the production of the silver halide photographic material. For example, in the case of adding the compound to the silver halide emulsion layer, it is preferred to add the compound at an optional time after finishing second ripening of the silver halide emulsion and immediately before coating the emulsion.

In addition, when the polyalkylene oxide derivative for use in this invention is added to the developer, the effect of this invention is obtained and in this case, the addition amount of the compound is from 0.1 g to 15 g per liter of the developer.

Furthermore, by incorporating at least one kind of inorganic or organic compounds having an acidic dissociation constant pKa of lower than 11 or the salts thereof in the silver halide photographic material which is used for the image-forming process of the present invention, good super high-contrast images can be formed at a rapid development processing time and over a wide development processing time.

As the inorganic compounds having an acidic dissociation constant pKa of lower than 11 and the salts thereof for use in the present invention, the inorganic compound having an acidic dissociation constant pKa of lower than 11 shown in Table 8.178 described in *Kagaku Binran (Chemcal Handbook), the Foundation*, page 994, edited by Nippon Kagaku Kai, published by Maruzen K.K., 1975 and the table "Acid Dissociation Constant pKa of Inorganic Compound in Water" in Table 5–7 described in John A. Dean, *Lange's Handbook of Chemistry*, the 13th revised edition, pages 5–14 to 5–17, published by McGraw-Hill Book Company, 1985 can be selectively used.

Specific examples of the inorganic compound having an acidic dissociation constant pKa of lower than 11 and the salts thereof for use in this invention are acids such as nitric acid, sulfuric acid, sulfurous acid, bisulfurous acid, phosphoric acid, phosphorous acid, hypophosphoric acid, metaphosphoric acid, hypophosphorous acid, amidophosphoric acid, carbonic acid, bicarbonic acid, hydrochloric acid, hydrobromic acid, hydroiodic acid, orthoboric acid, metaboric acid, aluminic acid, amidosulfuric acid, hydrazinosulfuric acid, sulfamic acid, and the alkaline metal salts, alkaline earth metal salts, aluminum salts, ammonium salts, and hydrazinium salts of these acids. Also, in the case of using strong acids having a negative dissociation constant pKa, such as nitric acid, sulfuric acid, hydrochloric acid, hydrobromic acid, etc., in the foregoing acids, it is preferred to use the acid as the salt thereof, such as the aluminum salt, ammonium salt, or hydrazinium salt.

Specific examples of the acid inorganic compound which is preferably used in this invention are amidosulfuric acid, ammonium amidosulfate, amidophosphoric acid, ammonium sulfite, potassium sulfite, potassium hydrogensulfite, sodium sulfite, sodium hydrogensulfite, sodium aluminate, magnesium aluminate, aluminum chloride, ammonium chloride, primary hydrazine chloride, secondary hydrazine chloride, ammonium magnesium chloride, orthoboric acid, orthophosphosphoric acid, potassium tetraborate, aluminum bromide, ammonium bromide, ammonium nitrate, aluminum nitrate, primary hydrazine nitrate, secondary hydrazine nitrate, hypophosphoric acid, sodium hypophosphate, disodium dihydrogen hypophosphate, sulfonylimide, ammonium carbonate, ammonium hydrogencarbonate, potassium hydrogencarbonate, sodium hydrogencarbonate, potassium magnesium hydrogencarbonate, lithium hydrogencarbonate, ammonium tetrachloroaluminate, sodium tripolyphosphate, sodium trimetaphosphate, potassium disulfite, sodium disulfite, pyrophosphoric acid, potassium pyrophosphate, sodium pyrophosphate, disodium dihydrogen pyrophosphate, magnesium pyrophosphate, sodium peroxyborate, hydrazinosulfuric acid, sodium sulfamate, phosphonic acid, potassium phosphonate, metaboric acid, ammonium metaborate, potassium metaborate, sodium metaborate, metaphosphoric acid, potassium metaphosphate, sodium metaphosphate, aluminum iodide, aluminum sulfate, ammonium sulfate, aluminum ammonium sulfate, aluminum potassium sulfate, ammonium hydrogensulfate, potassium hydrogensulfate, sodium hydrogensulfate, primary hydrazine sulfate, secondary hydrazine sulfate, ammonium magnesium sulfate, aluminum phosphate, ammonium phosphate, potassium phosphate, sodium phosphate, sodium ammonium hydrogenphosphate, diammonium hydrogenphosphate, dipotassium hydrogenphosphate, disodium hydrogenphosphate, ammonium dihydrogenphsophate, potassium dihydrogenphosphate, sodium dihydrogenphosphate, and ammonium magnesium phosphate, although the invention is not limited to these compounds.

The organic compounds having an acidic dissociation constant pKa of lower than 11, which can be preferably used in the present invention, include organic carboxylic acids, amino acids, organic sulfonic acids, organic sulfinic acids, organic sulfonamides, organic phosphoric acids, organic phosphonic acids, organic phosphinic acids, organic compounds having a phenolic hydroxy group, α-diketones, β-diketones, active methylene compounds having. pKa of lower than 11, organic boric acids, etc., and the ammonium salts, hydrazinium salts, aluminum salts, alkali metal salts and alkaline earth metal salts of these acids as well as primary, secondary, and tertiary amines, amides, organic hydrazines or heterocyclic compounds each having an acidic dissociation constant pKa of lower than 11 and the strong acid or weak acid salts of them.

As the organic compounds having an acidic dissociation constant pKa of lower than 11 for use in this invention, the organic compounds having the pKa value of lower than 11 shown in Table 8.179 described in *Kagaku Binran (Chemical Handbook), the Foundation*, pages 994 to 998, edited by Nippon Kagaku Kai, published by Maruzen K.K., 1975 and the table of "Acid Dissociation Constant pKa of Organic Compounds in Water" in Table 5–8 described in John A. Dean, *Lange's Handbook of Chemistry*, the 13th revised edition, pages 5–18 to 5–60, published by McGraw-Hill Book Company, 1985 can be selectively used.

Then, specific examples of the organic compound having an acidic dissociation constant pKa of lower than 11, which can be preferably used in the present invention, are shown below but the invention is not limited to them.

That is, preferred specific examples of the organic compound are isovaleric acid, isobutyric acid, octanic acid, cyclohexanecarboxylic acid, lactic acid, acetic acid, ammonium acetate, aluminum acetate, hydrazinium acetate, sodium acetate, potassium acetate, lithium acetate, cerium acetate, magnesium acetate, calcium acetate, strontium acetate, barium acetate, butyric acid, crotonic acid, azelaic acid, citric acid, succinic acid, oxalic acid, tartaric acid, fumaric acid, malonic acid, malic acid, lauric acid, myristic acid, palmitic acid, stearic acid, anisic acid, benzoic acid, p-aminobenzoic acid, naphthoic acid, terephthalic acid, pyromellitic acid, asparagine, aspartic acid, 4 -aminobutyric acid, alanine, isoleucine, glycine, glutamic acid, cysteine, serine, valine, histidine, methionine, leucine, sodium benzenesulfonate, sodium p-toluenesulfonate, sodium laurylsulfate, 5-sulfosalicylate, sodium laurylsulfoacetate, sodium 1-naphthalenesulfonate, sodium 2-naphthalenesulfonate, sodium 1-naphthol-4-sulfonate, sodium n-dodecylbenzenesulfonate, sodium 2,4-dimethylbenzenesulfonate, sodium 4-aminonaphthalene-1-sulfonate, disodium 1,5-naphthalenedisulfonate, sodium di-2-ethylhexylsulfosuccinate, sodium benzenesulfinate, benzenesulfonamide, p-toluenesulfonamide, benzoic acid-2-phosphoric acid, adenosine-2'-phosphoric acid, phenol-3-phosphoric acid,, galactose-1-phosphoric acid, sodium laurylphosphoric acid, benzenephosphonic acid, 2-aminoethylphosphonic acid, 2-bromo-p-tolylphosphonic acid, 2-methoxyphenylphosphonic acid, sodium phenylphosphinate, t-butylphosphinic acid, o-cresol, m-cresol, p-cresol, 4-amino-m-cresol, 2,4-dinitrophenol, o-bromophenol, p-phenolsulfonic acid, p-acetylphenol, ascorbic acid, reductine, ethyl 2-oxo-butanate, acetylacetone, ethyl malonate, N-methylacetoacetamide, 1-phenyl-3-methyl-5-pyrazolone, 3-hydroxyphenylboric acid, 3-aminophenylboric acid, β-phenylethylboric acid, aniline, aniline hydrochloride, aniline acetate, aniline sulfate, o-chloroaniline, anilinesulfonic acid, 1-naphthylamine, o-phenylenediamine, 2-aminoethanol hydrochloride, 2-(2-aminoethyl)pyridine hydrochloride, 3-aminoquinoline hydrochloride, 1,2-butanediamine hydrochloride, diethanolamine hydrochloride, diphenylamine, N-ethylaniline hydrochloride, N-methylethylamine hydrochloride, di(2-methoxyethyl)amine hydrochloride, triethanolamine hydrochloride, triallylamine hydrochloride, N,N-dimethyl-o-toluidine hydrochloride, N-methylmorpholine hydrochloride, acetamide hydrochloride, nicotinamide hydrochloride, isonicotinamide hydrochloride, phthalamide hydrochloride, hydrazine-N,N-diacetic acid, hydrazine-N,N'-diacetic acid, 4,4'-dipyridyl, methyl isonicotinate, 8-quinoline hydrochloride, quinoline hydrochloride, methyl picorate, 2,4-dimethylpyridine hydrochloride, 2,6-dimethylpyridine hydrochloride, piperazine hydrochloride, adenine, guanine, and cytosine.

The forgoing compound having an acidic dissociation constant pKa of lower than 11 and the salt thereof for use in the present invention is incorporated in at least one hydrophilic colloidal layer constituting the silver halide photographic material, and preferably in a light-insensitive hydrophilic colloidal layer which is coated adjacent to the negative-working silver halide emulsion layer, such as a protective layer, an interlayer an antihalation layer, or a filter layer.

For adding the foregoing compound having an acidic dissociation constant pKa of lower than 11 or the salt thereof for use in this invention to the negative-working silver halide emulsion layer or other light-insensitive hydrophilic colloidal layer, the compound may be added to the negative-working silver halide emulsion for use in this invention or an aqueous light-insensitive hydrophilic colloidal solution as a solution thereof in water or an organic solvent miscible with water, such as alcohols, ketones, esters, amides, etc.

The addition amount of the compound having an acidic dissociation constant pKa of lower than 11 or the salt thereof for use in this invention to a hydrophilic colloidal layer is suitable in the range of from $1\times10^{-5}$ mol to 5 mols, and particularly preferably in the range of from $5\times10^{-3}$ mol to 1 mol per mol of silver halide.

Then, the silver halide photographic material of the present invention is explained.

The silver halide photographic material of this invention has at least one emulsion layer composed of a negative-working silver halide emulsion. There is no particular restriction on the halogen composition of the silver halide emulsion being used and silver chloride, silver chlorobromide, silver iodobromide, silver iodobromochloride, etc., can be used. In this invention, the content of silver iodide of the silver halide emulsion is preferably not more than 5 mol %, and more preferably not more than 3 mol %.

The silver halide grains for use in this invention can have a relatively broad grain size distribution, but has preferably a narrow grain size distribution, and in particular, a monodispersed silver halide emulsion containing silver halide grains 90% of the total silver halide grains of which are within ±40% of the mean grain size is preferred.

The mean grain size of the silver halide grains for use in this invention is preferably not larger than 0.7 μm, and particularly preferably not larger than 0.4 μm. Also, the silver halide grains may have a regular crystal form such as cubic, octahedral, etc., or may have an irregular crystal form such as spherical, tabular, rounded wedge shape, etc.

The silver halide emulsion for use in this invention can be prepared by an optional known method. That is, an acid method, a neutral method, an ammoniacal method, etc., may be used and for the mixing process of a soluble silver salt and a soluble halide, a single jet method, a reverse mixing method, a double jet method, or a combination thereof can be used. When as one of double jet methods, a pAg controlled double jet method (C.D.J. method), that is a method of keeping a constant silver ion concentration (PAg) in a liquid phase of forming the silver halide grains is used, a monodispersed silver halide emulsion containing silver halide grains having a uniform crystal form and almost uniform grain sizes is obtained. During the formation or physical ripening of silver halide grains, a cadmium salt, an iridium salt, or a rhodium salt may exist in the system for increase the contrast of the silver halide emulsion formed.

It is preferred that the content of the binder contained in the silver halide photographic emulsion layer for use in the present invention is not over 250 g per mol of the silver halide. As binder, gelatin is most preferable but other hydrophilic colloids than gelatin can be used. For example, albumin, casein, graft polymers of gelatin and other polymers, hydrophilic synthetic polymers such as polyvinyl alcohol, polyacrylamide, etc., can be used.

The silver halide emulsion for use in this invention may not be chemically sensitized but usually is chemically sensitized. As the chemical sensitizing method, a sulfur sensitizing method, a reduction sensitizing method, a noble metal sensitizing method, or a combination thereof is used but a particularly preferred chemical sensitizing method for the practice of this invention is a sulfur sensitizing method and a combination of a sulfur sensitization and a gold sensitization which is one of noble metal sensitization.

For the sulfur sensitization, active gelatin, thiosulfates, thioureas, allylthiocarbamide, etc., can be used. For the gold sensitization, $HAuCl_4$, $Au(SCN)_2^-$ salt, $Au(S_2O_3)_2^{3-}$ salt etc., can be used.

The silver halide emulsion for use in this invention may be spectrally sensitized using one or more kinds of sensitizing dyes for imparting a spectral sensitivity at a desired wavelength region.

The silver halide photographic material of the present invention has at least one layer containing a negative-working silver halide emulsion on a support and may have other light-insensitive hydrophilic colloidal layers such as a protective layer, an interlayer, an antihalation layer, a filter layer, etc.

These hydrophilic colloidal layers may contain an inorganic or organic hardening agent. As the hardening agent, chromium salts (chromium alum, etc.), aldehydes (formaldehyde, glyoxal, etc.), N-methylol compounds (dimethylolurea, methyloldimethylhydantoin, etc.), active halogen compounds (2,4-dichloro-6-hydroxy-s-triazine, mucochloric acid, etc.), active vinyl compounds (1,3,5-triacryloylhexahydro-s-triazine, etc.), epoxy derivatives and aziridine derivatives hardening agents can be used.

The foregoing hydrophilic colloidal layer(s) for use in this invention can contain, if necessary, various photographic additives such as emulsion stabilizers (hydroxytetraazaindene compounds such as 6-hydroxy-4-methyl- 1,3,3a,7-tetraazaindene, etc.), spreading agents (saponin, etc.), gelatin plasticizers (copolymers of acrylic acid esters, etc.), antistatic agents, coating aids, various kinds of surface active agents (cationic, anionic, nonionic, and amphoteric surface active agents) for various purposes such as the improvement of photographic characteristics (e.g., a development acceleration and the increase of contrast, etc.), antifoggants (hydroquinone, 5-methylbenzotriazole, 1-phenyl- 5-mercaptotetrazole, etc.), matting agents, water-insoluble or sparingly water-soluble polymer latexes (homo- or copolymers of alkyl acrylate, alkyl methacrylate, acrylic acid, glycidyl acrylate, etc.) for improving the dimensional stability of the silver halide photographic material, etc., as long as the effects of the present invention are not reduced.

Then, the alkaline photographic developer being used in the present invention is explained. The developer of this invention is an alkaline developer containing at least an aminophenol derivative developing agent and a reductone compound.

Furthermore, for obtaining high-contrast images more rapidly and stably, the developer can contain at least one kind of the quaternary ammonium salt compounds shown by formula (C-I) described above, the amines shown by formula (C-II) or (C-III) described above, and the cyclic imino compounds shown by (C-IV) described above as a third component.

The quaternary ammonium salt compound shown by formula (C-I) for use in this invention is explained in detail.

As the alkyl group having from 1 to 20 carbon atoms shown by $R_{11}$, $R_{12}$, $R_{13}$, and $R_{14}$ in formula (C-I), an alkyl group having from 1 to 14 carbon atoms is particularly preferred and examples thereof are methyl, ethyl, propyl, isopropyl, n-butyl, n-hexyl, n-octyl, n-decyl, n-dodecyl, and n-tetradecyl. Also, these alkyl groups may have a substituent such as preferably a halogen atom, a hydroxy group, an alkoxy group, an acyloxy group, a carbamoyl group, and a trialkylammonium group.

Specific examples of the substituted alkyl group are 2-bromoethyl, hydroxyethyl, 3-hydroxypropyl, methoxyethoxymethyl, 2-acetoxyethyl, 2-n-propionyloxyethyl, 2-carbamoylethyl, 6-trimethylammoniumhexyl, and 10-trimethylammonium-n-decyl.

As the alkenyl group shown by $R_{11}$, $R_{12}$, $R_{13}$, and $R_{14}$ in formula (C-I), an alkenyl group having from 2 to 8 carbon atoms is particularly preferable and examples thereof are vinyl, allyl, 2-butenyl, 3-hexenyl, and 4-octenyl.

As the cycloalkyl group shown by $R_{11}$, $R_{12}$, $R_{13}$, and $R_{14}$, cyclopentyl and cyclohexyl are preferred. These cycloalkyl groups may be substituted with, preferably, an alkyl group (methyl, ethyl, etc.), a hydroxy group, or a hydroxyalkyl group (hydroxymethyl, 2-hydroxyethyl, etc.). Specific examples of the substituted cyaloalkyl group are 2-hydroxycyclopentyl, 3-hydroxycyclohexyl, 4-hydroxycyclohexyl, 3-(2'-hydroxyethyl)cyclopentyl, 3-(2'-hydroxyethyl)cyclohexyl, and 2-methylcyclopentyl.

As the unsubstituted or substituted aralkyl group shown by $R_{11}$, $R_{12}$, $R_{13}$, and $R_{14}$, benzyl, p-methoxybenzyl, p-methylbenzyl, p-hydroxymethylbenzyl, and m-hydroxymethylbenzyl are preferable.

Also, as the unsubstituted or substituted aryl group shown by $R_{11}$, $R_{12}$, $R_{13}$, and $R_{14}$, phenyl, p-tolyl, and p-hydroxymethylphenyl are preferable.

$X^{31}$ in formula (C-I) represents an anion such as an iodine ion, a bromine ion, a chlorine ion, a perchloric acid ion, a p-toluenesulfonic acid ion, a methylsulfuric acid ion, etc.

Then, specific examples of the quaternary ammonium salt compound shown by formula (C-I), which are preferably used in the present invention, are shown below but the invention is not limited to these compounds.

A-1: Tertamethylammonium bromide

A-2: Tetraethylammonium chloride

A-3: Ethyltrimethylammonium iodide

A-4: Methyltriethylammonium chloride

A-5: Ethyltri-n-propylammonium iodide

A-6: Tetra-n-propylammonium bromide

A-7: Tetra-n-butylammonium bromide

A-8: Tetra-n-amylammonium bromide

A-9: n-Hexyltrimethylammonium bromide

A-10: n-Octyltrimethylammonium bromide

A-11: n-Dodecyltrimethylammonium chloride

A-12: n-Dodecyltrimethylammonium bromide

A-13: n-Dodecyl-n-butyldimethylammonium bromide

A-14: n-Tetradecyltrimethylammonium bromide

A-15: Bromocholine bromide

A-16: Choline bromide

A-17: 2-Hydroxyethyltriethylammonium iodide

A-18: 2-Methoxyethoxymethyltriethylammonium chloride

A-19: Acetylcholine bromide

A-20: n-Butyrylcholine bromide

A-21: Carbamylcholine chloride

A-22: Hexamethonium bromide

A-23: Decamethonium iodide

A-24: Trimethylvinylammonium bromide

A-25: Diallyldimethylammonium chloride

A-26: 2-Butenyltrimethylammonium bromide

A-27: 3-Hexenyltrimethylammonium chloride

A-28: 4-Octenyltrimethylammonium bromide

A-29: Cyclopentyltrimethylammonium bromide

A-30: Cyclohexyltrimethylammonium bromide

A-31: 2-Hydroxycyclopentyltrimethylammonium bromide

A-32: 3-Hydroxycyclohexyltrimethylammonium bromide

A-33: 4-Hydroxycyclohexyltrimethylammonium bromide

A-34: 3-(2'-Hydroxyethyl)cyclopentyltrimethylammonium bromide

A-35: 3-(2'-Hydroxyethyl)cyclohexyltrimethylammonium bromide

A-36: 2-Methylcyclopentyltrimethylammonium bromide

A-37: Trimethylbenzylammonium chloride

A-38: Trimethylbenzylammonium bromide

A-39: Triethylbenzylammonium bromide

A-40: Trimethyl-p-methoxybenzylammonium bromide

A-41: Trimethyl-p-methylbenzylammonium bromide

A-42: Trimethyl -p-hydroxymethylbenzylammonium chloride

A-43: Trimethyl-m-hydroxymethylbenzylammonium chloride

A-44: Phenyltriethylammonium iodide

A-45: Trimethyltolylammonium bromide

A-46: Triethyl-p-hydroxymethylphenylammonium bromide

Then, the compounds shown by formula (C-II), (C-III), or (C-IV) are explained in detail.

As the alkyl group having from 1 to 10 carbon atoms shown by $R_{15}$, $R_{16}$, and $R_{17}$ in formula (C-II), an alkyl group having from 1 to 6 carbon atoms is particularly preferable and examples thereof are methyl, ethyl, propyl, isopropyl, n-butyl, and n-hexyl. These alkyl groups may be substituted with, preferably, a hydroxy group, a hydroxyalkoxy group, a hydroxyalkylthio group, or a carboxy group. Specific examples of the substituted alkyl group are 2-hydroxyethyl, 3-hydroxypropyl, 2,3-dihydroxypropyl, 2-(2'-hydroxyethoxy)ethyl, 2-(2'-hydroxythioethyl)ethyl, carboxymethyl, 2-carboxyethyl, and 5-carboxypentyl.

As the cycloalkyl group having from 3 to 10 carbon atoms shown by $R_{15}$, $R_{16}$, and $R_{17}$, cyclopentyl and cyclohexyl are preferred. These cycloalkyl groups may be substituted with preferably an alkyl group (methyl, ethyl, etc.), a hydroxy group, a hydroxyalkyl group (hydroxymethyl, 2-hydroxyethyl, etc.), or a carboxy group. Specific examples of the substituted cycloalkyl group are 2-hydroxycyclopentyl, 3-hydroxycyclohexyl, 4-hydroxycyclohexyl, 3-(2'-hydroxyethyl)cyclopentyl, 3-(2'-hydroxyethyl)cyclohexyl, 2-methylcyclopentyl, and 4-carboxycyclohexyl.

As the aralkyl group having from 7 to 10 carbon atoms shown by $R_{15}$, $R_{16}$, and $R_{17}$, benzyl, p-methoxybenzyl, p-methylbenzyl, p-hydroxymethylbenzyl, m-hydroxymethylbenzyl, and p-carboxybenzyl are preferable.

As the aryl group having from 6 to 10 carbon atoms, which may be substituted, shown by $R_{15}$, $R_{16}$, and $R_{17}$, phenyl, p-tolyl, p-hydroxymethylphenyl, o-carboxyphenyl, and p-carboxyphenyl are preferable.

Also, as the ring formed by optional two groups selected from $R_{15}$, $R_{16}$, and $R_{17}$, a saturated 5-membered, or 6-membered, or 7-membered ring is preferred and examples thereof are pyrrolidine, piperidine, morpholine, and hexamethyleneimine.

As the alkyl group having from 1 to 8 carbon atoms shown by $R_{18}$, $R_{19}$, $R_{20}$, and $R_{21}$ in formula (C-III), methyl, ethyl, propyl, isopropyl, n-butyl, and n-hexyl are preferable. These alkyl groups may be substituted with preferably a hydroxy group, a hydroxyalkoxy group, or a hydroxyalkylthio group. Specific examples of the substituted alkyl group are 2-hydroxyethyl, 3-hydroxypropyl, 2,3-dihydroxypropyl, 2-(2'-hydroxyethoxy)ethyl, and 2-(2'-hydroxythioethyl-)ethyl.

As the cycloalkyl group having from 3 to 8 carbon atoms shown by $R_{18}$, $R_{19}$, $R_{20}$, and $R_{21}$, cyclopentyl and cyclohexyl are preferable. These cycloalkyl groups may be substituted with preferably an alkyl group (methyl, ethyl, etc.), a hydroxy group, or a hydroxylakyl group (hydroxymethyl, 2-hydroxyethyl, etc.) and specific examples of the substituted cycloalkyl group are 2-hydroxycyclopentyl, 3-hydroxycyclohexyl, 4-hydroxycyclohexyl, 2-hydroxymethylcyclopentyl, 3-hydroxymethylcyclohexyl, and 2-methylcyclopentyl.

As the alkylene group having from 2 to 8 carbon atoms shown by B, ethylene, trimethylene, tetramethylene, pentamethylene, and hexamethylene are preferable.

As the ring formed by optional two groups selected from $R_{18}$, $R_{19}$, $R_{20}$, and $R_{21}$, a saturated 5-membered or 6-membered ring is preferred and examples thereof are pyrrolidine, piperidine, morpholine, and piperazine.

In formula (C-IV), $Q_1$ represents a nonmetallic atomic group necessary for forming an aromatic nitrogen-containing heterocyclic ring such as pyridine, quinoline, isoquinoline, acridine, pyridazine, pirimidine, pyrazine, cinnoline, quinazoline, quinoxaline, phthalazine, and phenazine. These aromatic nitrogen-containing ring may be substituted with an alkyl group such as methyl, ethyl, propyl, butyl, etc., a halogen atom, an alkoxy group, a hydroxy group, a carbamoyl group, an acetyl group, or an amino group.

Specific examples of the compounds shown by formulae (C-II), (C-III), and (C-IV), which are preferably used for the developer of the present invention, are shown below but the invention is not limited to these compounds.

A-47: Methylamine
A-48: Ethylamine
A-49: Propylamine
A-50: Isopropylamine
A-51: n-Butylamine
A-52: Isobutylamine
A-53: n-Amylamine
A-54: Isoamylamine
A-55: n-Hexylamine
A-56: 2-Heptylamine
A-57: Dimethylamine
A-58: Diethylamine
A-59: Dipropylamine
A-60: Diisopropylamine
A-61: Di-n-butylamine
A-62: Trimethylamine
A-63: Triethylamine
A-64: Cyclopentylamine
A-65: 2-Methylcyclopentylamine
A-66: Cyclohexylamine
A-67: N-Methylcyclopentylamine
A-68: N-Merthylcyclohexylamine
A-69: Benzylamine
A-70: p-Methylbenzylamine
A-71: p-Methoxybenzylamine
A-72: N-Methylbenzylamine
A-73: N-Methyl-p-methylbenzylamine
A-74: N-Methyl-p-methoxybenzylamine
A-75: Aniline
A-76: o-Toluidine
A-77: m-Toluidine
A-78: p-Toluidine
A-79: o-Aminobenzyl alcohol
A-80: p-Aminobenzyl alcohol
A-81: Methylaniline
A-82: Pyrrolidine
A-83: Piperidine
A-84: Hexamethyleneimine
A-85: Ethanolamine
A-86: 3-Amino-1-propanol
A-87: 2-Amino-1-propanol
A-88: 4-Amino-1-butanol
A-89: 2-Amino-1-butanol
A-90: 5-Amino-1-pentanol
A-91: 6-Amino-1-hexanol
A-92: 2-Hydroxycyclopentylamine
A-93: 3-Hydroxycyclohexylamine
A-94: 4-Hydroxycyclohexylamine
A-95: 3-(2'-Hydroxyethyl)cyclopentylamine
A-96: 3-(2'-Hydroxyethyl)cyclohexylamine
A-97: p-Hydroxymethylbenzylamine
A-98: m-Hydroxymethylbenzylamine
A-99: p-Hydroxymethylaniline
A-100: 2-(Ethylamino)ethanol
A-101: 2-Anilinoethanol
A-102: N-Benzylaminoethanol
A-103: N-(p-Methoxybenzyl)aminoethanol
A-104: 2-Dimethylaminoethanol
A-105: 2-Diethylaminoethanol
A-106: 3-Dimethylamino-1-propanol
A-107: 1-Dimethylamino-2-propanol
A-108: 3-Diethylamino-1-propanol
A-109: 3-Dimethylamino-1,2-propanediol
A-110: 3-Diethylamino- 1,2-propanediol
A-111: 3-Piperidino-1,2-propanediol
A-112: 3-Pyrrolidino-1,2-propanediol
A-113: 4-Dimethylamino-1-butanol
A-114: Morpholine
A-115: 1-Piperidinoethanol
A-116: Diethanolamine
A-117: N-Ethyldiethanolamine
A-118: 2,2'-(n-Butylimino)diethanol
A-119: N-Phenyldiethanolamine
A-120: N-Benzyldiethanolamine
A-121: N-Phenetyldiethanolamine
A-122: Triethanolamine
A-123: Triisopropanolamine
A-124: 2-(N,N-Diethylaminoethoxy)ethanol
A-125: 2-(N,N-Diethylamino-2'-ethylthio)ethanol
A-126: Glycine
A-127: β-Alanine
A-128: Serine
A-129: 2-Aminobutyric acid
A-130: 5-Amino-n-caproic acid
A-131: 1-Aminocyclohexanecarboxylic acid
A-132: 3-Aminocyclohexanecarboxylic acid
A-133: p-Carboxybenzylamine
A-134: o-Aminobenzoic acid
A-135: p-Aminobenzoic acid
A-136: Ethylenediamine
A-137: N-Ethylethylenediamine
A-138: N,N'-Dimethylethylenediamine
A-139: N,N'-Diethylethylenediamine
A-140: N,N-Dimethylethylenediamine
A-141: N,N,N'N'-Tetramethylethylenediamine
A-142: 1,3-Diaminopropane
A-143: N,N-Dimethyl-1,3-diaminopropane
A-144: N,N,N'N'-Tetramethyl-1,3-diaminopropane
A-145: 1,4-Diaminobutane A-146: N,N,N',N'-Tetramethyl-1,4-diaminobutane
A-147: 1,5-Diaminopentane
A-148: 2,2-Dimethyl-1,5-diaminopentane
A-149: N,N-Dimethylneopentanediamine
A-150: 1,6-Diaminohexane
A-151: N,N'-Dimethyl-1,6-diaminohexane
A-152: 1,7-Diaminopentane
A-153: 1,8-Diaminooctane
A-154: 2-(2'-Aminoethylamino)ethanol
A-155: 2-[(2'-Aminoethylamino)ethylamino]ethanol
A-156: 3,3'-Diaminopropylamine
A-157: Piperazine
A-158: N-Methylpiperazine
A-159: N,N'-Dimethylpiperazine
A-160: 1-(2'-Aminoethyl)piperazine
A-161: Hexamethylenetetramine
A-162: 1,4-Diazabicyclo[2,2,2]octane
A-163: Polyethyleneimine
A-164: Pyridine
A-165: 2-Acetylpyridine
A-166: 3-Aminopyridine
A-167: 3-Bromopyridine
A-168: 4-Ethylpyridine
A-169: 3-n-Butylpyridine
A-170: 2-Picoline
A-171: Nicotinic acid amide
A-172: 2-Methoxypyridine
A-173: 5-Aminoquinoline
A-174: 5,6,7,8-Tetrahydroisoquinoline
A-175: 3-Methylpyridazine
A-176: 2-Aminopyrimidine
A-177: Pyrimidine
A-178: Pyrazine
A-179: 2-Methylpyrazine
A-180: Cinnoline
A-181: Quinazoline
A-182: Quinoxaline
A-183: Phthalazine
A-184: Phenazine
A-185: 9-Aminoacridine
A-186: $H_2N(CH_2CH_2NH)_2H$
A-187: $H_2N(CH_2CH_2NH)_3H$
A-188: $H_2N(CH_2CH_2NH)_4H$
A-189: $H_2N(CH_2CH_2CH_2NH)_2H$
A-190: $H_2N(CH_2CH_2CH_2NH)_3H$
A-191: $H_2N(CH_2CH_2CH_2NH)_4H$
A-192: $(CH_3)_2NCH_2CH_2OCH_2CH_2N(CH_3)_2$
A-193: $(CH_3)_2N—(CH_2CH_2O)_2CH_2CH_2N(CH_3)_2$
A-194: $(CH_3)_2N—(CH_2CH_2O)_3CH_2CH_2N(CH_3)_2$
A-195: $(CH_3)_2N—(CH_2CH_2O)_4CH_2CH_2N(CH_3)_2$
A-196: $(CH_3)_2NCH_2CH_2SCH_2CH_2N(CH_3)_2$
A-197: $(CH_3)_2N—(CH_2CH_2S)_2CH_2CH_2N(CH_3)_2$
A-198: $(CH_3)_2N—(CH_2CH_2S)_3CH_2CH_2N(CH_3)_2$
A-199: $(CH_3)_2N—(CH_2CH_2S)_4CH_2CH_2N(CH_3)_2$ t,0950

The compounds shown by formulae (C-I), (C-II), (C-III), and (C-IV) for use in this invention are all known compounds and are commercially available as reagents or industrial chemicals.

The addition amount of each of the compounds shown by formulae (C-I), (C-II), (C-III), (C-IV) for use in this invention to the developer is from 0.01 g to 100 g, and preferably from 0.1 g to 50 g per liter of the developer. The foregoing compounds may be used singly or as a combination of them.

For adding the compounds shown by formulae (C-I), (C-II), (C-III), and (C-IV) for use in this invention to the developer, they may be added thereto as a solution thereof in water or an organic solvent miscible with water, such as methanol, ethanol, triethylene glycol, diethylene glycol, etc. Furthermore, these compounds may be directly added to the developer.

Then, the reductone compounds which are used for the developer of the present invention are generally known as endiol type compounds, enaminol type compounds, endiamine type compounds, thiol-enol type compounds, and enaminethiol type compounds.

Examples of these compounds are described in U.S. Pat. No. 2,688,549 and JP-A-62-237443. The synthesis methods of these reductone compounds are well known and they are described in-detail, e.g., in Yuuji Nomura and Hirohisa Oomura, *Reductone no Kagaku (Chemistry of Reductone)*, published by Uchida Rookakuho Shinsha K.K., 1969.

The particularly preferred reductone compounds for use in this invention are the compounds shown by formula (I) described above.

Then, specific examples of the particularly preferred reductone compounds for use in this invention are shown below.

Examples of the endiol type reductone compound: t,0990

Examples of other reductone compounds: t,1010

The reductone compounds for use in this invention can be used as the forms of the alkali metal salts such as lithium salts, sodium salts, potassium salts, etc. It is preferred that the reductone compound is used in an amount of from 1 to 100 g per liter of the developer.

For the developer of this invention, an aminophenol derivative developing agent is used. As the aminophenol derivative developing agent, there are 4-aminophenol, 4-amino- 3-methylphenol, 4-(N-methyl)aminophenol, 2,4-diaminophenol, N-(4-hydroxyphenyl)glycine, N-(2'-hydroxyethyl)- 2-aminophenol,2-hydroxymethyl-4-aminophenol, 2-hydroxymethyl-4-(N-methyl)aminophenol, etc., and the hydrochlorides and sulfates of these compounds, and N-methyl- 4-aminophenol sulfate (Metol) is particularly preferred. The addition amount of the aminophenol derivative developing agent to the developer is from 0.5 g to 10 g per liter of the developer.

It is preferable that the developer further contains a preservative and alkali in addition to the foregoing necessary components.

As the preservative, sulfites can be used. As the sulfites, there are sodium sulfite, potassium sulfite, lithium sulfite, ammonium sulfite, sodium bisulfite, potassium bisulfite, potassium metabisulfite, etc. The addition amount of the preservative is preferably not more than 0.5 mol per liter of the developer.

The alkali (alkali agent) is added to the developer for controlling pH of the developer to 9 or higher, and preferably from 10 to 11. As the alkali agent being used for adjusting pH, an ordinary water-soluble inorganic alkali metal salt such as sodium hydroxide, potassium hydroxide, sodium carbonate, potassium carbonate, potassium tertiary phosphate, etc., can be used.

The developer of this invention can also contain, if necessary, a water-soluble acid (e.g., acetic acid and boric acid), a pH buffer (e.g., sodium tertiary phosphate, sodium carbonate, potassium carbonate, sodium metaborate, and lithium tetraborate), an inorganic antifoggant (e.g., sodium bromide and potassium bromide), an organic antifoggant (e.g., 1-phenyl-5-mercaptotetrazole and 5-nitroindazole), an organic solvent (e.g., ethylene glycol, diethylene glycol, and methyl cellosolve), a color toning agent, a surface active agent, a defoaming agent, a hard water softener, etc., in addition to the foregoing components in the range of not reducing the effects of the invention.

The processing temperature of the developer of the present invention is in the range of from 18° C. to 50° C. and preferably from 20° C. to 40° C.

As a fixing solution for use in this invention, a composition generally used can be used. For example, the fixing agents described in *Shashin Kogaku no Kiso, Gin-en Shashin Hen (The Foundation of Photographic Engineering, Silver Halide Photography)*, page 330 and below, edited by Nippon Shashin Gakkai, published by Corona Publishing Co., Ltd., 1979; Akira Sasai, *Shashin no Kagaku (Chemistry of Photography)*, page 320 and below, published by Shashin Kogyo Shuppan Sha, 1982; and W. Thomas, Jr., *SPSE Handbook of Photographic Science and Engineering*, page 528, published by John Wiley & Sons, 1973 can be referred to.

As the fixing agent, thiosulfates, thiocyanates, and organic sulfur compounds which are known to have the effect as a fixing agent can be used. Also, as an auxiliary fixing agent, an acid agent (e.g., acetic acid and citric acid), a preservative (e.g., sodium sulfite), a buffer (e.g., boric acid), and a hardening agent (e.g., potassium alum, aluminum alum, and aluminum sulfate) can be used for the fixing solution.

Then, the invention is explained more practically by following examples but the invention is not limited to the examples within the scope of the present invention.

EXAMPLE 1

By simultaneously adding an aqueous silver nitrate solution and an aqueous solution of a mixture of potassium bromide and sodium chloride (Br:Cl=30:70 by molar ratio) containing sodium hexachlororhodate(III) in an amount of $1.5\times10^{-7}$ mol per mol of silver to an aqueous gelatin solution kept at 40° C. while keeping pAg at 7.2 over a period of 75 minutes, a monodispersed silver chlorobromide emulsion (AgCl70 mol %) containing the cubic crystal silver halide grains having a mean grain size of 0.28 μm was prepared. Then, after removing soluble salts by an ordinary method, $5\times10^{-5}$ mol of sodium thiosulfate per mol of silver halide was added to the emulsion and the emulsion was subjected to chemical ripening at 50° C. for 100 minutes. The silver halide emulsion obtained contained 80 g of gelatin per mol of silver halide.

After adding thereto $6\times10^{-3}$ mol of 6-hydroxy-4-methyl-1,3,3a,7-tetraazaindene per mol of silver halide, the silver halide emulsion was split into two portions. To one of the split emulsions was added no sensitizing dye and to another split emulsion was added a sensitizing dye (D-18, reduction potential −1.24 volt) at $8{,}000\times10^{-6}$ mol per mol of silver halide, and each of the split emulsions was coated each of polyethylene terephthalate bases each having a subbing layer at a silver coverage of 40 mg/dm$^2$. Then, a gelatin protective layer containing formaldehyde and dimethylolurea as hardening agents was coated on each emulsion layer followed by drying to provide film sample No. 1 (using the emulsion containing no sensitizing dye) and film sample No. 2 (using the emulsion containing the sensitizing dye).

After exposing each of the film samples thus prepared to a tungsten lamp of 2666° K. using an LB-200 filter through a step wedge having a step difference of 0.15 for 5 second, each sample was developed with each of developers 1, 2, 3, and 4 having the following compositions, stopped, fixed, washed, and dried. t,1060

The photographic characteristics obtained are shown in Table 1. t,1080

In the above table, the relative sensitivity was the relative value of the reciprocal of the exposure amount of giving density 3.0 of the sample being evaluated from which fog was subtracted with the sensitivity of film sample No. 1 in Test No. 1 developed with Developer 1 for 5 minutes at 20° C. being defined as 100. The gamma was shown by the mean slope between the densities 0.5 and 3.0 from which fog was subtracted and the fog was shown by the density at the unexposed area.

As is clear from the results shown in Table 1, when the film sample containing a large amount of the dye having a negative reduction potential satisfying the factor of the present invention is developed with the developer containing the aminophenol derivative developing agent and the reductone compound, remarkably high sensitivity and high contrast are obtained. However, when film samples are developed with Developer 2 (Kodak D-11 Formula; High-Contrast MQ Developer) described in Akira Sasai, *Saishin Shashin Shoho Binran (Newest Photographic Formula Handbook)*, published by Shashin Kogyo Shuppan Sha, 1983, Developer 3 (FD-185 Formula, by Fuji Photo Film Co., Ltd,; Lith Type Developer), or Developer 4 (a developer formula for super high-contrast development using the hydrazine derivative), a high contrast is not obtained and a remarkably high sensitivity is not obtained even when a large amount of the dye having a negative reduction potential is incorporated in the film samples.

The foregoing phenomenon of obtaining a high sensitivity and a high-contrast by the dye having a negative reduction potential has not been known until now and an utterly new fact discovered by the inventors.

EXAMPLE 2

By simultaneously adding an aqueous silver nitrate solution and an aqueous solution of a mixture of potassium bromide and sodium chloride (Br:Cl=30:70 by molar ratio) containing sodium hexachlororhodate(III) in an amount of $1.5\times10^{-7}$ mol per mol of silver to an aqueous gelatin solution kept at 40° C. while keeping pAg at 7.2 over a period of 75 minutes, a monodispersed silver chlorobromide emulsion (AgCl 70 mol %) containing the cubic crystal silver halide grains having a mean grain size of 0.28 μm was prepared. After removing soluble salts therefrom by an ordinary method, $5\times10^{-5}$ mol of sodium thiosulfate per mol of silver halide was added to the silver halide emulsion and the emulsion was subjected to chemical ripening for 120 minutes at 52.2° C. The silver halide emulsion obtained contained 80 g of gelatin per mol of silver halide. Then, after adding to the emulsion $6\times10^{-3}$ mol of 6-hydroxy-4-methyl-1,3,3a,7-tetraazaindene per mol of silver halide, the emulsion was split into many small portions. Then, after adding to each of the split portions each of the dyes or the pyridinium salt derivatives shown in Table 2 below and each of the polyalkylene oxide derivatives and each of the dyes or the pyridinium salt derivatives shown in Table 3, each emulsion was coated on a polyethylene terephthalate (PET)

base at a silver coverage of 40 mg/dm$^2$ followed by drying. t,1110 t,1120

Then, gelatin protective layer containing formaldehyde and dimethylolurea as hardening agents was coated on each emulsion layer followed by drying to provide film sample Nos. 3 to 28.

Each of the film samples was exposed to a tungsten lamp of 2666° K. using an LB-200 filter through a step wedge having a step difference of 0.15 for 5 seconds as in Example 1, developed with Developer 1 in Example 1 for 5 minutes at 20° C., stopped, fixed, washed, and dried.

The photographic characteristics of the samples thus obtained are shown in Table 4 below. t,1130

In Table 4, the relative sensitivity is the relative value of the reciprocal of the exposure amount of giving density 3.0 excluding fog to each film sample with the sensitivity of Film Sample No. 3 developed with Developer 1 for 5 minutes at 20° C. being defined as 100. The gamma is the mean slope between densities 0.5 and 3.0 excluding fog, and the fog is the density at the unexposed area. The pepper is evaluated by 5 ranks by observing the unexposed portion of each film sample by a magnifying lens of 50 magnifications, wherein A shows the best quality (substantially no pepper) and E shows the worst quality. Ranks A and B are suitable for practical use, rank C is a low quality but acceptable for practical use, and ranks D and E are unacceptable.

As is clear from the results shown in Table 4, it can be seen that by developing the film sample containing each of the dyes or the pyridinium salt derivatives having a negative reduction potential; the dye and the polyalkylene oxide derivative; or the pyridinium salt derivative and the polyalkylene oxide derivative with the developer containing the aminophenol derivative developing agent and the reductone compound, remarkably high sensitivity and high contrast are obtained as compared with sample Nos. 3 and 18 containing no compound for use in this invention. No pepper occurs on the film samples of the present invention.

EXAMPLE 3

After exposing the film of Sample No. 3 prepared as in Example 2 by the same manner as in Example 2, an ethanol solution of $1\times10^{-3}$M of each of the compounds shown in Table. 5 below was spreaded on each exposed film sample at $8\times10^{-3}$ mol of the compound per mol of silver halide as the calculated amount and dried to provide Sample Nos. 29 to 37. Similarly, an ethanol solution containing $3\times10^{-4}$M of each of the dyes shown in Table 5 and 2 g/liter of the polyalkylene oxide (P-8) was spreaded on each of the films of Sample No. 3 pre-exposed by the same manner as above at 0.3 mmol of the dye and 2 g of the polyalkylene oxide per mol of silver halide as the calculated amounts and dried to provide Sample Nos. 38 and 39. Furthermore, an ethanol solution containing $8\times10^{-4}$M of each of the pyridinium salt derivatives shown in Table 5 and 2 g/liter of the polyalkylene oxide derivative (P-8) was spreaded on each of the films of Sample No. 3 pre-exposed by the same manner as above at 0.8 mmol of the pyridinium salt derivative and 2 g of the polyalkylene oxide per mol of silver halide as the calculated amounts and dried to provide sample Nos. 40 and 41. t,1160

Each of the film samples shown in Table 5 was developed with Developer 1 in Example 1 for 5 minutes at 20° C., stopped, fixed, washed, and dried.

The photographic characteristics obtained are shown in Table 6. t,1170

In Table 6, the relative sensitivity is shown by the relative sensitivity of the reciprocal of the exposure amount giving each sample density of 3.0 excluding fog with the sensitivity of Sample No. 29 developed with Developer 1 for 5 minutes at 20° C. being defined as 100. The gamma is shown by the mean slope between densities of 0.5 and 3.0 excluding the fog, and the fog is shown by the density at the undeveloped area. The pepper is evaluated in 5 ranks by observing the unexposed portion of the film sample with a magnifying lens of 50 magnifications, wherein A shows the best quality (substantially no pepper) and E shows the worst quality. Ranks A and B are suitable for practical use, Rank C is a low quality but acceptable for practical use, and ranks D and E are unacceptable.

As is clear from Table 6, it can be seen that when after spreading and drying the dye or the pyridinium salt derivative having a negative reduction potential; the dye and the polyalkylene oxide derivative; or the pyridinium salt derivative and the polyalkylene oxide derivative on the previously exposed film, the film is developed with a developer containing the aminophenol derivative developing agent and the reductone compound, remarkable high sensitivity and high contrast are obtained as compared with the case of developing comparison sample No. 29 which does not contain the compound for use in this invention.

As described above, it can be seen that for obtaining high sensitivity and high contrast by the image-forming process of the present invention, the compound(s) having a negative reduction potential for use in this invention not always exist at image-exposure of the silver halide photographic material but may exist at development. In this case, peppers did not occur in any film samples of the present invention.

EXAMPLE 4

After exposing each film of Sample No. 3 prepared in Example 2 as in Example 2, each sample was developed with Developer 1 or Developer 1 added with each compounds shown in Table 7 and adjusted the pH thereof to 10.8, i.e., each of Developers 5 to 9 for 5 minutes at 20° C., stopped, fixed, washed and dried. t,1190

Then, the photographic characteristics were evaluated as in Example 2 and the results obtained are shown in Table 8 below. t,1200

In Table 8, the relative sensitivity is shown by defining the sensitivity in Developer 1 (Comparison Example) as 100 and other photographic characteristics are same as in Example 2.

As is clear from the results shown in Table 8, by adding the compound having a negative reduction potential for use in this invention to the developer, images having a high sensitivity and a high contrast are obtained. On the other hand, when the compound having a negative reduction potential for use in this invention does not exist (Test No. 9), such a high sensitivity and high contrast are not obtained.

EXAMPLE 5

After adding $6\times10^{-3}$ mol of 6-hydroxy-4-methyl-1,3,3a, 7-tetraazaindene and 0.3 mmol of the dye D-18 (reduction potential: −1.24 volt) for use in this invention per mol of silver halide to the chemically ripened silver chlorobromide emulsion obtained by the same manner as in Example 1, the emulsion was coated on a polyethylene terephthalate base at a silver coverage of 40 mg/dm$^2$. The emulsion layer was protected with a gelatin protective layer containing formaldehyde and dimethylolurea as hardening agents.

The film sample thus prepared was exposed as in Example 2, developed with each of Developers 10 to 15 having adjusted pH of 10.8 and having each composition shown in Table 9 below for 3 minutes at 30° C., stopped, fixed, washed and dried. t,1220

The photographic characteristics obtained are shown in Table 10 below. t,1230

In Table 10, the relative sensitivity is the relative value with the sensitivity of Test No. 15 (this example) being as 100. Other photographic characteristics are same as in Example 2.

As is clear from the results shown in Table 10, it can be seen that in the case of carrying out the development in the existence of the polyalkylene oxide according to the image-forming process of this invention, images having a high sensitivity and high contrast are obtained.

EXAMPLE 6

After adding $6\times10^{-3}$ mol of 6-hydroxy-4-methyl-1,3,3a, 7-tetraazaindene per mol of silver halide to the chemically ripened silver chlorobromide emulsion obtained by the same manner as in Example 1, the emulsion was split into many small portions and after adding each of the polyalkylene derivatives shown in Table 11 to each of the split emulsion, each emulsion was coated on a polyethylene terephthalate base at a silver coverage of 40 mg/dm$^2$. t,1240

Each of the emulsion layers was protected with a gelatin protective layer containing formaldehyde and dimethylolurea as hardening agents. Each of the film samples thus prepared was exposed as in Example 2, developed with each of Developer 1 in Example 1 and Developers 16 and 17 formed by adding the dye (D-9: reduction potential −1.29 volt) or the pyridinium salt derivative (N-63: reduction potential −1.08 volt) to Developer 1 as shown in Table 12 for 3 minutes at 30° C., stopped, fixed, washed, and dried. t,1250

The photographic characteristics obtained are shown in Table 13. t,1260

In Table 13, the relative sensitivity is the relative value with the sensitivity of Sample No. 42 developed with Developer 1 of Test No. 21 (Comparison Example) being defined as 100. Other photographic characteristics are same as in Example 2.

As is clear from the results shown in Table 13, it can be seen that in the case that the polyalkylene oxide exists in the film sample and the compound having a negative reduction potential for use in this invention exists in the developer, high sensitivity and high contrast are obtained. On the other hand, in the case of the comparison examples without meeting the factors of the present invention, only images having low contrast are obtained.

EXAMPLE 7

After adding $8\times10^{-3}$ mol of 6-hydroxy-4-methyl-1,3,3a, 7-tetraazaindene and $8\times10^{-3}$ mol of the pyridinium salt derivative (N-4: reduction potential −1.08 volt) to the chemically ripened silver chlorobromide emulsion obtained by the same manner as in Example 2, the emulsion was coated on a polyethylene terephthalate base at a silver coverage of 40 mg/dm$^2$. The emulsion layer was protected with a gelatin protective layer containing formaldehyde and dimethylolurea as hardening agents. The film sample thus prepared was exposed as in Example 2 and developed with each of Developer 18 having the following composition and Developer 18 further added with each of the compounds of foregoing formula (C-1), (C-II), (C-III), or (C-IV) shown in Table 14 below (i.e., Developers 19 to 30) at 30° C. t,1280 t,1290

After development, each sample was stopped, fixed, washed, and dried to provide a sample being evaluation and the photographic characteristics were measured.

The photographic characteristics obtained are shown in Table 15.

In Table 15, the development time is the development time required from the initiation of the development to the density excluding fog becoming 3.0 shown by a 15 second unit. The relative sensitivity, fog, gamma, and pepper are values when the density of each evaluation sample excluding fog is 3.0. Also, the relative sensitivity is the relative value of the reciprocal of the exposure amount giving density 3.0 excluding fog with the sensitivity of the sample developed Developer No. 18 containing no compound for use in this invention for 3 minutes being defined as 100. Other photographic characteristics as same as in Example 2. t,1300

As is clear from the results shown in Table 15, it can be seen that high sensitivity and high contrast are obtained with all the developers but in the case of using each of Developers 19 to 30 each containing the compound shown by formula (C-I), (C-II), (C-III), or (C-IV), super high-contrast negative images having density 3.0 are formed at a shorter developing time as compared with the case of using Developer 18 containing no compound for use in this invention. Also, the pepper did not occur in each case.

EXAMPLE 8

After adding $8\times10^{-3}$ mol of 6-hydroxy-4-methyl-1,3,3a, 7-tetraazaindene and $8\times10^{-3}$ mol of the pyridinium salt derivative (N-4: reduction potential −1.08 volt) per mol of silver halide to the chemically ripened silver chlorobromide emulsion obtained as in Example 2, the emulsion was coated on a polyethylene terephthalate base at a silver coverage of 40 mg/dm$^2$. In the emulsion layer was coated each of various gelatin protective layers containing each of the compounds having an acidic dissociation constant pKa of lower than 11 shown in Table 16 together with formaldehyde and dimethylolurea.

In this case, before and after coating the protective layer, the coated amount of the protective layer was measured and the addition amount of the compound per mol of silver coated was calculated. t,1320

After exposing each of the film samples thus prepared to a tungsten lamp of 2666° K. using an LB-200 filter through a step wedge having a step difference of 0.15 for 5 seconds, each film sample was developed with Developer 18 in Example 7 containing Metol as an aminophenol derivative developing agent and ascorbic acid (1-1) as the reductone compound, stopped, fixed, washed and dried. The developing condition was 30° C. and the developing time was changed from 30 seconds to 5 minutes, whereby the change of the photographic characteristics with the change of the developing time was measured.

The photographic characteristics obtained are shown in Table 17. As the photographic performance in Table 17, the developing time necessary for giving the maximum density 3.0 to each sample is shown by a 15 second unit and the photographic performance at the case is shown. Also, the value when the developing time is 6 minute is shown.

In Table 17, the relative sensitivity is the relative value of the reciprocal of the exposure amount giving density 3.0 excluding fog to each sample with the sensitivity of the sample of Film Sample No. 56 developed for 1 minute and 45 seconds at 30° C. being defined as 100. The gamma is shown by the mean slope between densities 0.5 and 3.0 excluding fog, the fog is the density at the unexposed area, and Dmax is the maximum density of the film excluding fog. t,1340

As is clear from the results shown in Table 17, in the case of developing Film Sample Nos. 47 to 58 containing the compound having a negative reduction potential and the compound having an acidic dissociation constant pKa of lower than 11 with Developer 18, super high-contrast images having a gamma of 15 or higher are obtained with a more rapid developing time and also the good super high-contrast images are stably obtained with wider developing times.

As described above, it can be seen that by using the film containing the compound having a negative reduction potential and the compound having an acidic dissociation constant pKa of lower than 11, images can be formed under more preferred practical developing conditions.

EXAMPLE 9

After adding $8\times10^{-3}$ mol of 6-hydroxy-4-methyl-1,3,3a,7-tetraazaindene and $8\times10^{-3}$ mol of the pyridinium salt derivative (N-22: reduction potential −1.15 volt) to the chemically ripened silver chlorobromide emulsion obtained as in Example 2, the emulsion was coated on polyethylene terephthalate base at a silver coverage of 40 mg/dm$^2$. On the emulsion layer was coated a gelatin protective layer containing 83 mmols of 5-sulfosalicylic acid (pKa: 2.5, 12.0 in water of 25° C.) per mol of silver halide together with formaldehyde and methylolurea as hardening agents.

Before and after coating the protective layer, the coating amount of the protective layer was measured and the addition amount of 5-sulfosalicylic acid per mol of the coated silver amount was calculated.

After exposing the film sample thus prepared to a tungsten lamp of 2666° K. using an LB-200 filter through a step wedge having a step difference of 0.15 for 5 seconds, the sample was developed with each of Developers 31 to 35 formed by adding each of the compounds shown in Table 18 below to Developer 18 in Example 7 containing Metol as an aminophenol developing agent and ascorbic acid (1-1) as the reductone, stopped, fixed, washed, and dried. In the developing condition, the developing time was changed from 30 seconds to 5 minutes at 30° C. wherein the change of the photographic characteristics with the change of the developing time were determined. t,1360

The photographic characteristics obtained are shown in Table 19. As the photographic performance in Table 19, the developing time necessary for giving the maximum density 3.0 to each sample is shown by a 15 second unit and the photographic performance at the case is shown. Also, the value when the developing time is 5 minutes is shown.

In Table 19, the relative sensitivity is the relative value of the reciprocal of the exposure time giving density 3.0 excluding fog to each sample with the sensitivity of the film sample developed with Developer 31 for 5 minutes at 30° C. being defined as 100. The gamma is the mean slope between densities 0.5 and 3.0 excluding fog, and the fog is the density at the unexposed area. t,1370

As is clear from the results shown in Table 19, it can be seen that according to the image-forming process of the present invention of developing the silver halide photographic material of this invention containing the compound having a negative reduction potential and the compound having an acidic dissociation constant pKa of lower than 11 with the developer containing the aminophenol derivative developing agent, the reductone, and the amino compound for use in this invention, good super high-contrast images are formed more preferably, more rapidly and stably for developing time between one minute to 5 minutes at 30° C.

EXAMPLE 10

By simultaneously adding an aqueous silver nitrate solution and an aqueous potassium bromide solution containing $3.0\times10^{-7}$ mol of sodium hexabromorhodate(III) per mol of silver to an aqueous gelatin solution kept at 60° C. while keeping pAg at 7.0 over a period of 60 minutes, a monodispersed silver bromide emulsion containing the cubic crystal silver halide grains having a mean grain size of 0.22 μm was prepared. After removing soluble salts by an ordinary method, $25\times10^{-5}$ mol of sodium thiosulfate per mol of silver halide was added to the emulsion and the emulsion was subjected to chemical ripening for 70 minutes at 60° C. After adding $12\times10^{-3}$ mol of 6-hydroxy-4-methyl-1,3,3a,7-tetraazaindene and $8\times10^{-3}$ mol of the pyridinium derivative (N-28: reduction potential −0.80 volt) per mol of silver bromide to the foregoing silver bromide emulsion, the emulsion was coated on a polyethylene terephthalate base at a silver coverage of 40 mg/dm$^2$. On the emulsion layer was coated a gelatin layer containing each of the compounds having an acidic dissociation constant pKa of lower than 11 for use in this invention shown in Table 20 together with formaldehyde and dimethylolurea as hardening agents followed by drying to provide Film Samples 59 to 65.

The coated amount of the added compound was measured by the same manner as in Example 8. t,1390

Each of Film Samples 59 to 65 was exposed as in Example 2, developed with each of Developers 18 and 29 in Example 7 and Developers 31 to 35 in Example 9 for a time of from 30 seconds to 5 minutes at 30° C. stopped fixed washed, and dried.

The photographic characteristics obtained are shown in Table 21. t,1400

As the same as in Example 9, the values when the developing time required to give density 3.0 excluding fog from the initiation of the development was shown by a 15 second unit and the values at the developing time of 5 minutes. The relative sensitivity was the relative value of the reciprocal of the exposure amount giving density 3.0 excluding fog with the sensitivity of Film No. 59 of this invention in Test No. 37 developed with Developer 29 for 2 minutes at 30° C. being defined as 100.

As is clear from the results shown in Table 21, according to the image-forming process of this invention, even when the silver bromide emulsion is used, the high sensitivity and high contrast occur as in Test No. 36 and good images can be obtained. Furthermore, in Test No. 37 wherein the amino compound is added to the developer and Test No. 38 wherein the compound having an acidic dissociation constant pKa of lower than 11 is added to the film, high-contrast images can be stably and more rapidly formed over a wide developing time. Moreover, in Test Nos. 39 to 43 wherein after imagewise exposing, the film containing the compound having a negative reduction potential and the compound having an acidic dissociation constant pKa of lower than 11 was developed with the developer containing the aminophenol derivative developing agent, the reductone compound, and the amino compound, the development can be more efficiently carried out and high-contrast images can be stably formed.

EXAMPLE 11

Each of Film Sample Nos. 52 and 55 prepared in Example 8 and Film Sample Nos. 62 and 64 prepared in Example 10 was imagewise exposed as in Example 2, developed with Developer 36 having the following composition for 20, 30, and 40 seconds at 38° C., stopped, fixed, washed, and dried. t,1420

The photographic performance obtained is shown in Table 22 below. t,1430

In Table 22, the relative sensitivity is the relative value of the reciprocal of the exposure amount of giving density 3.0 excluding fog with the sensitivity of the sample of Film No. 52 of this invention developed for 30 seconds at 38° C. being defined as 100. The fog and the gamma are same as in Example 2. Dmax is the maximum density of each film excluding fog.

As is clear from the results shown in Table 22, it can be seen that according to the image-forming process of this invention, good super high-contrast negative images are stably obtained at 38° C. in a practical developing time of from 20 seconds to 40 seconds.

While the invention has been described in detail and with reference to specific embodiments thereof, it will be apparent to one skilled in the art that various changes and modifications can be made therein without departing from the spirit and scope thereof.

What is claimed is:

1. A process of forming a super high-contrast negative image, which comprises the steps of imagewise exposing a negative-working silver halide photographic material comprising a support having thereon one or more hydrophilic colloidal layers, at least one of said one or more hydrophilic colloidal layers being a negative-working silver halide emulsion layer, and then developing the photographic material with a developer containing an aminophenol derivative developing agent and a reductone compound in the existence of an organic compound selected from the group consisting of a pyridinium salt or a derivative thereof, a quinolinium salt or a derivative thereof, and an isoquinolinium salt or a derivative thereof, said organic compound having a reduction potential more negative than −0.06 volt, and being present in an amount of $1\times10^{-4}$ to $1\times10^{-2}$ mol per mol of silver halide and effective to increase contrast to 10 or higher in gamma.

2. The process of forming a super high-contrast negative image of claim 1, wherein the organic compound having a negative reduction potential exists in said one or more hydrophilic colloidal layers.

3. The process of forming a super high-contrast negative image of claim 1, wherein a polyalkylene oxide or the derivative thereof exists in said one or more hydrophilic colloidal layers.

4. The process of forming a super high-contrast negative image of claim 1, wherein a polyalkylene oxide or the derivative thereof exists in the developer.

5. The process of forming a super high-contrast negative image of claim 1, wherein the silver halide photographic material further contains an inorganic or organic compound having an acidic dissociation constant pKa of lower than 11 in said one or more hydrophilic colloidal layers.

6. The process of forming a super high-contrast negative image of claim 1, wherein the developer contains an amine.

7. The process of forming a super high-contrast negative image of claim 1, wherein the developer contains a cyclic imino compound.

8. The process of forming a super high-contrast negative image of claim 1, wherein the developer contains a quaternary ammonium salt compound.

9. The process of forming a super high-contrast negative image of claim 1, wherein the organic compound having a negative reduction potential is a pyridinium salt or the derivative thereof.

10. The process of forming a super high-contrast negative image of claim 1, wherein the organic compound having a negative reduction potential is a quinolinium salt or the derivative thereof.

11. The process of forming a super high-contrast negative image of claim 1, wherein the organic compound having a negative reduction potential is an isoquinolinium salt or the derivative thereof.

* * * * *